United States Patent [19]

Oddsen

[11] 4,056,818

[45] Nov. 1, 1977

[54] AUTOMATIC SURVEILLANCE SYSTEM FOR TIME SEQUENCE OPERATIONS

[76] Inventor: Robert Oddsen, 136 W. Waterview, Northport, N.Y. 11768

[21] Appl. No.: 644,697

[22] Filed: Dec. 29, 1975

[51] Int. Cl.[2] ..... G08B 21/00

[52] U.S. Cl. ..... 340/309.4; 340/309.1; 235/92 PD

[58] Field of Search ..... 340/309.4, 309.1; 235/92 PD, 92 T, 92 TF; 200/28; 307/139; 74/3.56

[56] References Cited

U.S. PATENT DOCUMENTS 2,344,497 3/1944 Cooney ..... 235/92 PD UX

*Primary Examiner*—Harold Pitts
*Attorney, Agent, or Firm*—Arthur A. March

[57] ABSTRACT

An automatic system for the surveillance of the incremental speeds of production equipment including a pair of rotary driven gears rotatable about a common axis and in face to face relation. The rotary driven members are independently driven by activating stepping, cocking means including a pulse energized solenoid. An arm laterally movable in response to said pulse extends from a position adjacent the solenoid. Adjacent the forward end of the arm there is a coil spring frictionally maintained in engagement around a shaft and having an extension adapted to be engaged by said arm. A leaf spring is disposed rearwardly of the extension of said coil spring. When the arm moves in response to the pulse it contacts and rotates the coil spring and also moves the leaf spring into taut or cocked position. When the arm is released by the interruption of the pulse the leaf spring is also released as well as the coil spring. The reciprocating action causes the leaf spring to engage the coil spring extension and in then the coil spring to slightly tighten on the shaft to move the shaft one increment. A driving gear carried below the coil spring on the same shaft is thereupon rotated one increment and being in contact with one of the driven rotary gears drives it to the same extent. When a differential in rate of rotation of the rotary gears occurs, sensing means signal such difference to permit the situation to be corrected.

33 Claims, 7 Drawing Figures

AUTOMATIC SURVEILLANCE SYSTEM FOR TIME SEQUENCE OPERATIONS

BACKGROUND OF THE INVENTION

It is currently essential to produce a predetermined quantative amount of work product during a given period which will make the production operation economical and profitable. It is substantially imperative that the amount of production accomplished in time sequence operations be determined at frequent intervals without interrupting the operations to perform an ultimate automatic or manual counting of the number of products produced or work accomplished. Thus, a surveillance is necessary to police the efficiency of time sequence operations whether the operation be accomplished automatically, manually or partially manually.

In certain industries a definite number of time sequence operations are required in a given period of time in order to maintain the balance or operating rate of the production line in constant and even flow. In other words, the production step obtained in each unit of the time sequence provides the difference between practical commercial sucess and failure. Despite this fact, there are little, if any successful and dependable economical means by which the efficiency of time sequence operations can be, at all times, effectively ascertained. There is a dearth of surveillance means which can measure and signal the fact that a virtually infinitesimal slowdown has occurred despite the effect of the collective increments of such a slowdown on the overall operation.

Use of large computers and the like has been attempted for the foregoing purposes. The expense thereof and their lack of reliability under many conditions in actual practice have indicated that they do not provide the proper solution to the problem. Furthermore, the results of the surveillance must be made immediately known to the user of the surveillance system in order that corrective measures be taken before any substantial loss is incurred and this has not been economically accomplished.

SUMMARY OF THE INVENTION

The present invention overcomes the foregoing problems and provides an efficient, ecomonical and entirely dependable system for policing any and all types of time sequence production or similar operations. It provides an accurate surveillance system in which the most efficient and desirable time sequence of operation may be predetermined and preset and become the absolute norm or guide within the same system for the efficiency of the time sequence operations accomplished by the producing equipment whether the production be automatic, manual, or partially manual.

The user of the automatic surveillance system may determine the most productive rate for the time sequence production operation, and by reason of the system of the inventive concept herein, this rate will act as the continuous guide for the time sequence of the work actually being accomplished. In addition, should there be any deviation in the time sequence production operation from the preset desired norm, a signal will automatically be generated which will make this deviation immediately known to the user so that corrective measures may be immediately instituted.

In accomplishing the foregoing beneficial results, an economical structural system is provided which, if desired, can occupy only a relatively minute space. In accordance with one embodiment of the invention, there are two rotary members which are disposed in operative facing relation to each other to rotate about a common axis. Each of these rotary members is provided around its perimeter with serrations or is provided with other means by which its rotation is accomplished. In connection with the following description such rotary members will be designated from time to time as "gears" although it will be understood that this term is not intended to be a limitation upon the fundamental concept or constructional means for its accomplishment. Each of the rotary members is in effect a driven gear with both members rotating, as aforesaid, about the same axis. Each rotary gear is provided with a driving gear for operative engagement around its perimeter. Each of the driving gears is caused to rotate through means connected to and movable by means responsive to impulses, as for example the magnetic impulses created through a solenoid. The movement of the gear is accomplished by means of a movable arm arranged for impulse operative engagement with the responsive means or solenoid which arm extends outwardly from the solenoid to contact indirectly and press operatively against the front side of resilient means, as for example, a relatively flat leaf spring. The leaf spring depends from the top of the housing adjacent to the solenoid.

A coil spring having an extension disposed between the arm and the leaf spring is secured to the same shaft which carries the driving gear and is located at a point above the driving gear. When a magnetic impulse is generated by the solenoid the arm arranged for operative engagement therewith moves laterally against the extension of the coil spring and indirectly against the flat leaf spring to cause them to move laterally. This action puts the coil spring and the leaf spring under tension and places the unit in cocked position. When the pulse terminates, the arm disengages from the solenoid releasing the coil spring and its abutting leaf spring both of which return to their original positions in a lateral direction reverse to the initial thrust. The coil spring thereby tightens around the shaft and rotates the shaft one increment and in turn rotates the driving gear one increment. This action will, of course, cause the driving gear to rotate the driven gear a similar increment.

The forgoing arrangement for driving the first of the driven rotary members is substantially identical to the structure used for driving the other, or second, driven rotary gears. In other words, the second driven member is rotated through a similar solenoid, arm, leaf spring, coil spring and driving gear arangement.

In accordance with the present concept of a surveillance system one or the first of the activating solenoids is provided with a predetermined input, i.e. a premeasured frequency to operate the solenoid and thus provide an optimum guide for the entire time sequence stepping operation. For example, the sequence may be set for the most efficient and already proven time sequence in the operation of the downstroke of a punch press or other piece of production equipment. As a consequence, the particular arrangement will provide the norm or guide for the efficient operation of the production equipment which is under surveillance.

The other, or second, activating solenoid is coupled to the random impulse which is supplied by an electrical connection to the particular production equipment or the like which is actually in operation. Thissolenoid through the chain above described drives the second driven gear. Thus, when both rotary members on the same axis are proceeding at the same rate of speed, the time sequence of the production equipment under surveillance is operating under the best or optimum conditions as the time sequence is exactly that of the norm or guide.

There are switch means disposed between and carried by the two rotary members which are arranged to provide a signal when one of the rotary members is out of phase with the other. The specific switch means utilized are in the form of a raised conductive member secured to the upper surface of the first or lower driven gear and movable conducting pins extending at predetermined locations through the second or upper driven gear. Each of the pins is carried by a flat spring member which is attached to the upper driven gear to maintain the pin in the aperture extending through the upper driven gear.

Disposed above said movable pins are concentric circular contact rings which are resiliently maintained in and carried by a bracket housing extending over the rotary gears. Each circular ring has a vertical extension adapted to pass through the upper part of the housing and to make or break contact with audible or visible signal means in the form of lights or noise-making indicators.

When one of the driven gears is out of phase with the other, contact will be made between the raised conductive member on the lower driven gear and one of the pins extending through the upper driven gear. This will cause the pin to move upwardly to contact one of the concentric circular rings and move it upwardly. This movement in turn will cause its respective vertical extension to make contact with the signal means. Thus, a circuit to a particular signal means will thereby be energized to provide the user with the indication that the rotary gears are out of phase with each other and that consequently something is amiss with the time sequence operation of the production equipment.

The pins in the upper rotary member are so arranged that contact will be made between one of them and the raised conductive member on the lower rotary gear when this gear is out of phase on the slow side, while the other pin will be contacted by the conductive member and raised to provide still another signal when the gear is out of phase on the fast side. Such signals, within the purview of the invention, may be the lighting of lights of the same or different colors or the provision of audible sounds of the same or different frequencies.

In addition, the present invention provides for a counter-balance in the form of another or second coil spring disposed below the corresponding driving gear. This coil spring is carried by the same shaft as that which carries the driving gear and the first coil spring. It is provided with an extension which bears against a fixed stop. Thus, when the first coil spring means is being rotated around the driving shaft by the movement of the arm in response to a pulse, it will be prevented from causing the shaft to rotate an undesired or extended distance in the same direction. The second coil spring will maintain the shaft substantially in its original position counter-balancing any undesired forces exerted by the first coil spring. This balance arrangement provides for a very close and efficient surveillance in all instances. It is, of course, possible with the present invention to provide an arrangement whereby the gears are moved more than one increment if desired and it is further possible through the use of reduction gearing or the like to impart motions of a variety of different speeds and/or incremental amplitudes or linear or rotary distances for different uses. In addition, it is always possible to change the frequency at any time to vary the cycle of the solenoid and any suitable pulse generator may be used for this purpose.

In addition, the fact that one of the gears is out of phase may be transmitted through suitable conductors to a recorder, counter or computer or any means for performing any functions desired by the user with inexpensive, concise and totally dependable arrangements.

In essence, therefore, there are provided in the automatic surveillance system first and second rotary members which are mounted adjacent to each other to be rotated about a common axis. The invention also provides first and second pulse energized rotation imparting means for independently moving each of said rotary members a predetermined rotational increment. The incremental rate of this rotation corresponds with the timing of the pulses from its associated imparting means. There are also sensing means on the first rotary member and contact means on the second rotary member which together sense whether or not the rotary members are rotating in phase or out of phase with each other. One of the rotary members is rotated at a selective constant time pulse and theother at random time pulse corresponding to the time sequence operation under surveillance. There has thus been presented a new and novel method for automatic surveillance following the structure and the steps above described.

DETAILED DESCRIPTION OF THE INVENTION

Figure 1:
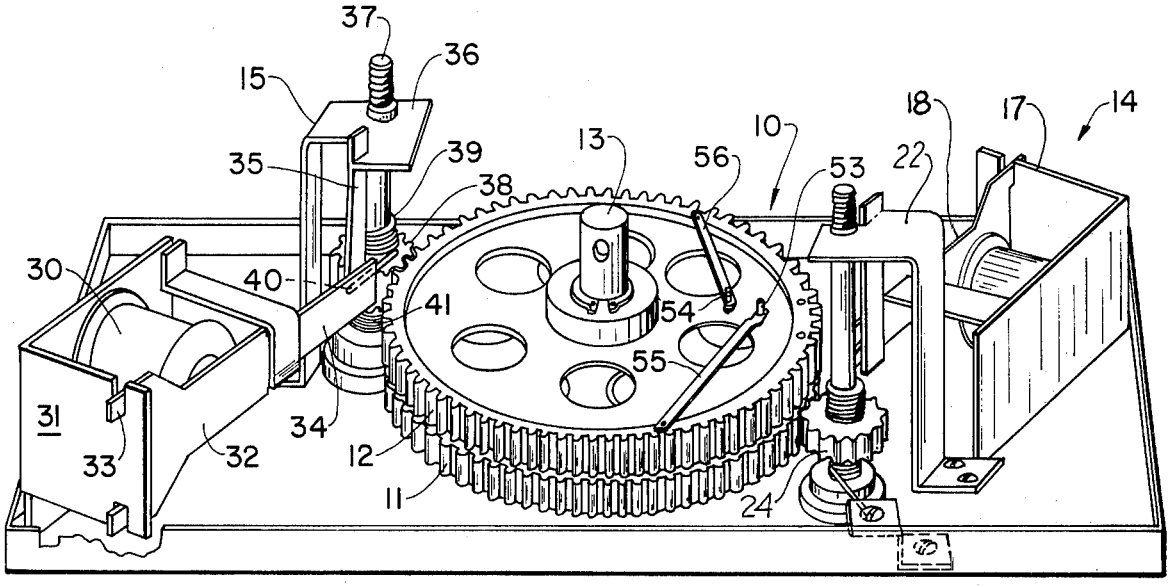
FIG. 1 is a perspective view of a portion of the automatic surveillance system apparatus according to an embodiment of the present invention.

The automatic surveillance system of the present invention comprises a suitable housing 10 containing a pair of rotary members 11 and 12 adapted to be rotated about a common axis 13 which is secured to the housing. As illustrated, the rotary members are in the form of gears in facing relation to, but spaced apart from each other. Each gear is driven by independent activating means 14 or 15 which are substantially identical in structure but a mirror image of each other in arrangement.

The activating means 14 drive the rotary gear member 11 and comprise a solenoid 16 which is suitably secured to the base of the housing by any appropriate fastening means. A bracket member 17 is disposed adjacent to the solenoid and carries an arm 18 which is articulatedly anchored to the bracket at its rearward end 19. The forward end 20 of said arm is free for lateral movement of selectively limited amplitude in the manner hereinafter described. Disposed adjacent to the free end 20 of the arm 18 is a resilient urging member or flat leaf spring 21 which, as shown, depends from an upper plate of the bracket 22 and is without support at its bottom portion so that the leaf spring 21 may also be capable of lateral movement. The leaf spring 21 is disposed substantially at right angles to the arm 18.

Figure 5:
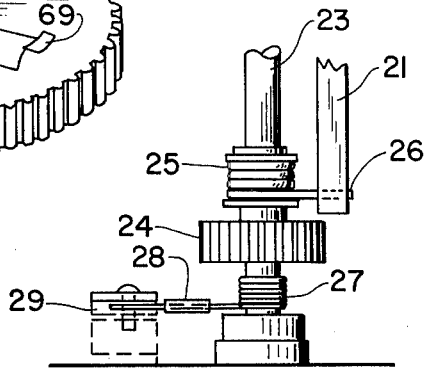
FIG. 5 is a partial side view showing the actuating elements for driving the automatic surveillance means and the equalizing means for maintaining the drive means in balanced position.

A shaft 23 is secured between the base and upper portions of the housing immediately adjacent to the rotary member 11. Disposed intermediate the shaft or post 23 is a driving member 24 in the form of a gear or the like which operatively engages the driven rotary member or gear 11. The rotary gear members 24 and 11 have the normal operative coupling between the serrations or teeth around the perimeter of each of said members. Disposed above driving gear member 24 is a coil spring 25 which is secured to the same shaft 23 in any suitable manner. A free extended end or extension 26 of the reciprocating coil spring 25 is disposed between the front surface of the leaf spring and the arm, extending substantially parallel to the arm and at substantially right angles to the leaf spring. Disposed below the driving gear 24 is a balancing coil spring 27 (FIG. 5). The second coil spring 27 is disposed in restraining relation to the shaft 23 to prevent the shaft from excessive rotation under the cocking pressure of the end of coil spring 25 hereinafter described. A free end 28 extending from the second coil spring 27 abuts and contacts a stop 29 for this purpose. Thus, these operatively opposed coil springs from corresponding forward and reverse unidirectional gripping means helical orientation which cooperate to achieve unidirectional incremental rotation of the associated driving gear by alternate gripping and release of the shaft on which the driving gear is rotatably mounted.

The method of operation of the activating unit 14 to drive the rotary member 11 is as follows:

The solenoid is provided with an input viz. a premeasured frequency. A magnetic impulse is thereby generated by the solenoid 16. In a known manner this impulse will cause the free end 20 of the arm 18 to move laterally in the direction of the right arrow in FIG. 2. This movement causes the arm 18 to engage and bear against the extension 26 of the spring 25 and in turn the leaf spring 21. This action cocks the coil spring 25 around the shaft 23 and places the leaf spring 21 under tension. In accordance with the balance system achieved by these unique surveillance means the shaft 23 and the gear 24 will not be rotated by this movement in any excessive manner because of the force exerted against clockwise rotation of the driving gear by the restraining coil spring member 27 whose extension 28 bears against stop 29 to prevent the aforesaid excessive clockwise movement of the driving gear 25. The activating elements are at this time in cocked position.

Figure 2:
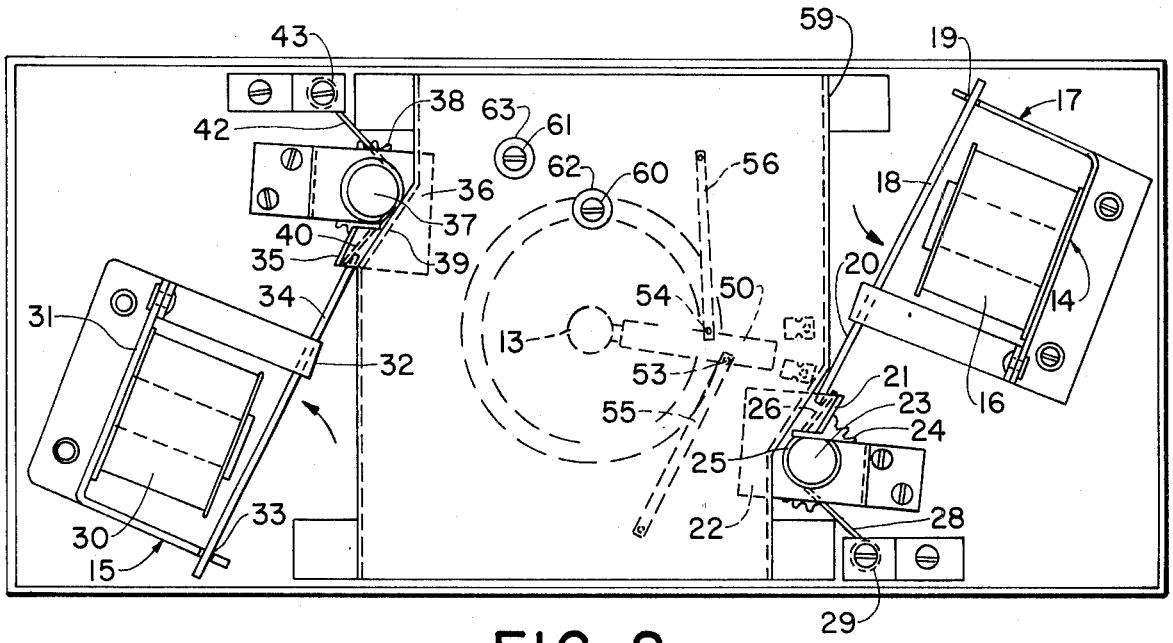
FIG. 2 is a top view of the apparatus of FIG. 1 with the driven gears and signal means assembly omitted.
Figure 3:
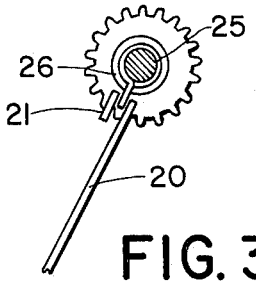
FIG. 3 is a top view of the actuating elements for driving the automatic surveillance means shown in uncocked or inoperative position.
Figure 4:
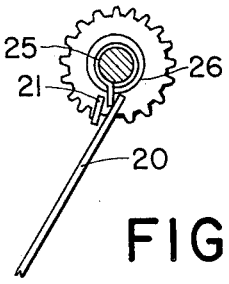
FIG. 4 is a top view showing the actuating elements for driving the automatic surveillance means in a cocked position.
Figure 6:
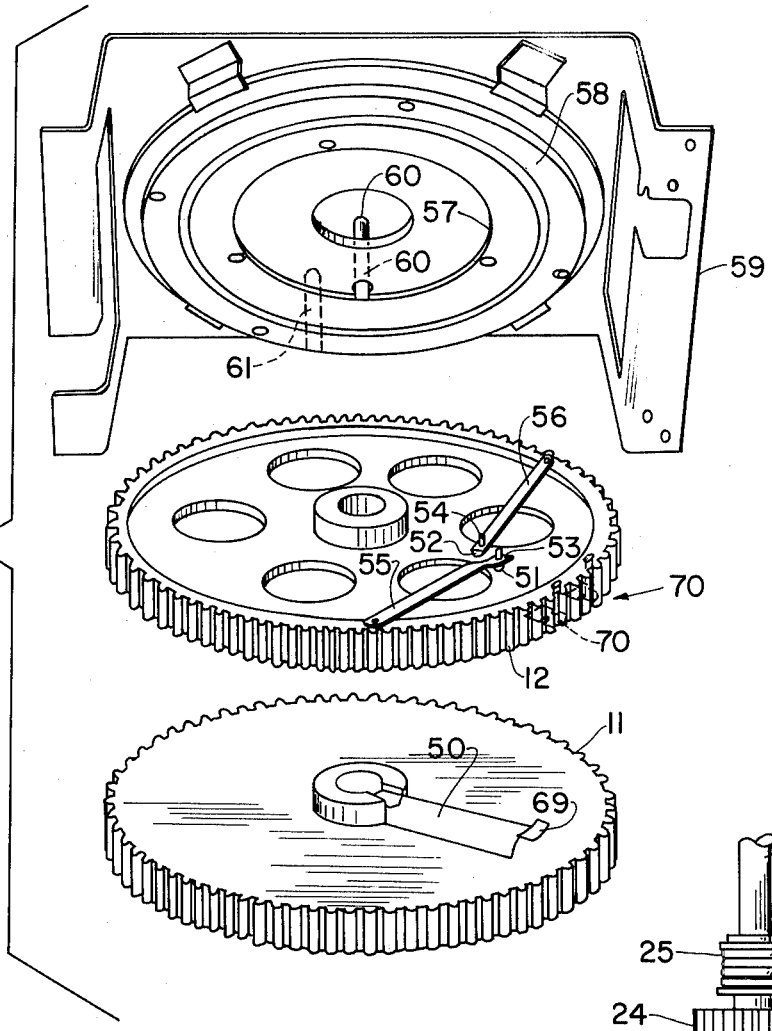
FIG. 6 is an exploded view partially in perspective of the driven members and the sensing contact and signal means of the surveillance system of the present invention.

When the solenoid's magnetic impulse is momentarily stopped, the arm 18 is released from its magnetic engagement therewith and its free end 20 moves laterally in the direction opposite to that shown by the right arrow in FIG. 2. Under these conditions the engagement of the arm 18 with the front surface of the leaf spring 21 and the extension of the coil spring 25 is also momentarily interrupted. The reciprocating coil spring 25 having the pressure against it, is then released and coupled with the return action of the leaf spring 21. Both springs then move under their reserve force in the opposite direction from that shown by the right arrow in FIG. 2. This movement thrusts the leaf spring against the extension of the coil spring whereupon the coil spring tightens slightly around the shaft and rotates it one increment while the balancing coil spring 27 loosens its counter-gripping hold on the shaft to permit such rotation. This rotational movement is immediately imparted to the driving gear 24 which is also caused to move one increment as is the engaged driven gear 11.

As a consequence, it can be seen that with the automatic surveillance system of the present invention there is a pulse energized rotation imparted by the solenoid which through the foregoing structural elements causes the driven gear member 11 to move in selective amplitude rotational increments in accordance with the timing of the pulse which is generated.

The other or second activating means 15 are substantially identical to although in mirror image of the first activating means 14.

It comprises a solenoid 30 which is suitably secured to the base of the housing by any appropriate fastening means. A bracket member 31 is disposed adjacent to the solenoid and carries an arm 32 which is anchored to the bracket at its rearward end 33. The forward end 34 of said arm is free for lateral movement in the manner hereinafter described. Disposed adjacent to the free end 34 of the arm 32 is a flat leaf spring 35 which, as shown, depends from an upper place of the bracket 36 and is without support at its bottom portion so that the leaf spring 35 may also be capable of lateral movement. The leaf spring 35 is disposed substantially at right angles to the arm 32.

A shaft 37 is secured between the base and upper portions of the housing immediately adjacent to the rotary member 12. Disposed intermediately on the shaft 37 is a driving member 38 in the form of a gear or the like which operatively engages the driven rotary member or gear 12. The rotary members 38 and 12 have the normal operative coupling between the serrations around the perimeter of each of said members. Disposed above driving gear member 38 is a coil spring 39 which is secured to the same shaft 37 in any suitable manner. A free extended end 40 of the reciprocating coil spring 39 is disposed between the front surface of the leaf spring 35 and the arm 32, extending substantially parallel to the arm and at substantially right angles to the leaf spring. Disposed below the driving gear 38 is a balancing coil spring 41. This second coil spring 41 is disposed in restraining relation to the shaft 37 to prevent the shaft from excessive rotation under the cocking pressure of the coil spring 39 hereinafter described. A free end 42 extending from the second coil spring 41 abuts and contacts a stop 43 for this purpose.

The method of operation of the activating unit 15 to drive the rotary member 12 is as follows:

The solenoid is provided with an input viz. a premeasured frequency. A magnetic impulse is thereby generated by the solenoid 30. In a known manner this impulse will cause the free end 34 of the arm 32 to move laterally in the direction of the left arrow in FIG. 2. This movement causes the arm 32 to engage and bear against the extension 40 of the coil spring 39 and against the leaf spring 35. This action cocks the coil spring 39 around the shaft 37 and places the leaf spring 35 under tension. In accordance with the balance system achieved by these unique surveillance means the shaft 37 and the gear 38 will not be rotated by this movement in any excessive manner because of the force exerted against rotation of the shaft 37 by the balancing coil spring member 41 whose extension 42 bears against stop 43 to prevent the aforesaid excessive movement of the shaft 37 and thus the driving gear 38. The activating elements are at this time in cocked position.

When the solenoid's magnetic impulse is momentarily stopped the arm 32 is released from its magnetic engagement therewith and its free end 34 moves laterally in the direction opposite to that shown by the left arrow in FIG. 2. Under these conditions the engagement of the arm 32 with the front surface of the leaf spring 35 and the extension of the coil spring 39 is also momentarily interrupted. The reciprocating coil spring 39 having the pressure against it is then released and coupled with the return action of the leaf spring 35. Both springs then move in the opposite direction from that shown by the left arrow in FIG. 2. This movement thrusts the leaf spring against the extension 40 of the coil spring 39 whereupon the coil spring tightens slightly around the shaft and rotates it, one increment, while at the same time the balancing coil spring 41 loosens its counter-gripping held on the shaft to permit such rotation. This rotational movement is immediately imparted to the driving gear 38 which is also caused to move one increment as is the engaged driven gear 12.

As a consequence, it can be seen that with the automatic surveillance system of the present invention there is a pulse energized rotation imparted by each solenoid which through the foregoing structural elements causes the driven gear member to move in selective amplitude rotational increments in accordance with the timing of the pulse which is generated.

In accordance with the present invention the unique automatic surveillance system is accomplished by in effect sensing the difference in the relative rotational movement between rotary members 11 and 12 per unit time or reference pulse rate.

Hereinafter specific examples are given and structure defined with one of the rotary members being designated as the norm or guide while the other is described in relation to a random operation. However, these descriptions are only for exemplary purposes and the positions of the parts and their functions may be reversed or modified without in any way deviating from the inventive concept.

In accomplishing the highly desirable results, a pre-measured frequency or input is provided for solenoid 16 thus creating energization at a predetermined time pulse rate. This energization pulse rate is preset to be the most efficient, economical and desirable time pulse rate which is selected by the user of the surveillance system. In other words, this time pulse is the selective optimum standard or norm.

The other solenoid 30 is energized by suitable well known means for energizing a solenoid (not shown) which will be electrically connected and operatively responsive to the production equipment or work piece. As a consequence, the energization of solenoid 30 for driving driven gear 12 is a random time pulse which depends upon the time sequence operation under surveillance, that is, the operation of the machine or work piece itself. In the event, for example, the machine under surveillance is a punch press or the like the random time pulse would be generated by the time sequence of the downward stroke and the operation of the press which in turn would be transmitted to solenoid 30.

Therefore, as described above, rotary driven members 11 and 12 which are in face to face relationship with each other are driven by solenoids concordantly energized by different means, one being a preset energization pulse and the other a random time energization pulse. When the pulses energized by each solenoid are identical or synchronous the rotary members 11 and 12 will rotate at exactly the same incremental speeds and be essentially in synchrony. However, should the production equipment lag behind the normal preset optimum rate or should it increase in speed over that rate, rotary member 12 will rotate at a slower or faster rate than the rotation of rotary member 11 depending upon the rate of variance.

In accordance with the present invention means are provided to sense or ascertain the difference in relative rotational movement between the first and second rotary members. These means include a raised cam member or crested sensing bridge 50 which is disposed over the inner surface of rotary member 11. This member is preferably carried by the rotary member 11 itself, e.g. in substantially extending relation. Driven rotary member 12 is provided with apertures 51 and 52 which form sleeves or bushings in which contact means are carried. These contact means are illustrated in the form of pins 53 and 54 which are slidably disposed within sleeves 51 and 52 in preferably rotationally spaced apart and radially off set relation and are maintained in their positions by their securment to resilient plates 55 and 56 outwardly disposed over and secured to the top of rotary member 12.

As part of the unique surveillance system concentric contact rings 57 and 58 are resiliently axially movably carried by bracket member 59 extending over the top of the rotary members 11 and 12. The outer edges of the concentric rings 57 and 58 are each provided with signal means which may be in the form of corresponding axially movable vertical extensions or pins 60 and 61 extending through apertures forming sleeves therefor 62 and 63 in the bracket 59, whereby to switch on a corresponding signal via ultimate signal means such as a light bulb L or a bell B or the like as the case may be. The resiliency of the concentric rings may be accomplished by the provision of cushioning material, e.g. a plurality of peripherally distributed loaded coil springs 64, as shown, or any other suitable means for providing such resiliency may be utilized.

Figure 7:
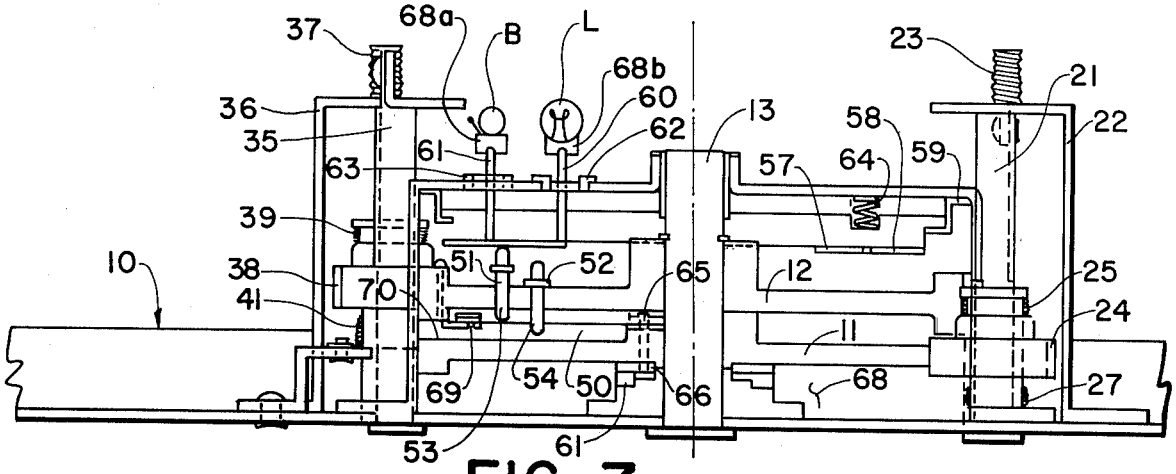
FIG. 7 is a sectional view showing the sensing contact and signal means in operative condition when the rotary driven members are out of phase with each other.

The method and apparatus by which one can ascertain the fact that the relative rotational speeds of rotary members 11 and 12 are different when this difference occurs by using the aforesaid methods and apparatus can be appreciated from the following:

In the event the production equipment or work piece should fall behind the pre-set optimum norm the random input to the solenoid 30 will also lag and the energization pulses will be less frequent. As a consequence, the arm 32 will reciprocate in a slower manner as will the movement of the coil spring 39 and in turn the driving gear 38. The slowdown will affect the rotational speed of the driven gear 12 whereupon driven gear 11 operating at the standard norm will rotate at a relatively faster rate. At a particular point the bridge 50 on a driven gear 11 will overtake and contact pin 53 and with both members moving in the same general clockwise direction the bridge 50 will urge against pin 53 and raise it to the position shown in FIG. 7. The pin 53 will in turn press against its adjacent concentric ring 58 moving the resilient rings upwardly, visually self-signalling causing extensions 60 and 61 to move in sleeves 62 and 63 up through the upper portion of the plate to effect their exposure and/or to effect contact with the same or different type of visual or audible signal generating means as the case may be. Thus, an audible signal may be given as in the instance shown, via pin 53, extension 61 and Bell B, and/or a visual signal may be given correspondingly via pin 53, extension 60 and Bulb L, i.e. that the production equipment is out of phase with the norm so that corrective measures can be taken.

In the event the production equipment begins to move at a faster rate than the optimum norm the random pulses of the solenoid 30 will occur more frequently causing through the above-described chain the rotary member 12 to rotate at a more rapid speed than rotary member 11. In this instance the contact means or pin 54 will be raised to engage its respective concentric ring 57 similarly causing the ring assembly to move upwardly and the visually self-signalling extensions 60 and 61 to be upwardly displaced and through such apertures in the bracket 59 to effect such exposure and/or to effect contact with the same of different type of visual or audible signal generating means. Thus, a visual signal may be given as in the instance shown, via pin 54, extension 62 and light bulb L, and/or an audible signal may be given correspondingly vis pin 54, extension 61 and bell B, so as to indicate a differential in the time sequence of the production equipment or work piece.

Furthermore, in accordance with the present invention it is possible to determine not only that there is a differential between the rotational speeds of the surveillance rotary members 11 and 12 but also to determine whether the difference is a result of the slower or the result of the more rapid time sequence operation of the production piece. This would be accomplished merely by providing an electrical contact through the bridge 50 and making the pins 53 and 54 concentric rings 57 and 58 and extension or pins 60 and 61 of conductive material.

For this purpose, bridge 50 can be corrected via rivet 65 with wiper ring 66 on the underside of rotary member 11 in sliding contact with stationary ring 67 on housing 10 to complete a parallel circuit to the corresponding signal means L and B via line 68 and parallel contacts **68*a* and 68*b*, i.e. back to pins 51 and 52 through pins 60 and 61 and contact rings 57 and 58**.

It will be understood, therefore, that a current would flow from the bridge 50 through the contacted pin 53 or 54 these parts constituting energizing switch means, depending upon whether the random rate of rotation of driven member 12 was slower or faster than that of the standard rate set by driven member 11. The current would continue to flow through one of the concentric rings 57 or 58 again dependent upon which contact pin 53 or 54 was raised, and the current would continue to flow out only through the respective extension or pin 60 or 61 which was connected to the appropriate concentric ring 57 or 58. As such signalling means, in particular different colored lights could be electrically connected to pins 60 and 61 or sound producing devices of different decibals of sound could be connected to the same pins for auricular signalling.

It is possible when the bridge 50 bears against contact pins 53 or 54 that the driven members 11 and 12 may tend to separate a slight distance from each other. In order to prevent such occurrences, a lip 69 is disposed slightly above lower rotary member 11 and extends parallel to the surface plane of said rotary member, e.g. by attachment to the radially outer end of the medial crest of bridge 50 as an outwardly directed lip. The lower edge portion of the upper rotary member 12 is also provided with a downwardly extending flange or plate member 70, a portion of which extends parallel to the undersurface plane of the rotary member 12, e.g. by attachment to the lower surface peripheral portion thereof as a radially inwardly directed lip engaging plate member. The structure is so arranged that when the bridge 50 engages either of the pins 53 or 54, the lower rotary member lip 69 will be disposed in operative radial range above the extension of the upper rotary member plate member 70 to prevent any further separation between the two rotary members 11 and 12. Thus, by the provision for such interengaging means 69 and 70, it is insured that contact will be maintained throughout for the signalling purposes hereinbefore described.

It is possible with the structure of the present invention to maintain an accurate measure of the work being produced on the device under surveillance. A determination of the number of increments accomplished by the rotational movement of the random driven gear will show, in effect, the work produced. Thus, if the work produced is less or more than a preset amount, the difference between the increments of the driven gear of the standard can be measured against the increments accomplished by the gear driven by the random pulses generating from the equipment under surveillance.

Of course, it will be appreciated that the standard driven gear can be driven by any suitable activating means, such as an electric motor operatively coupled thereto by a conventional appropriate infinitely variable selective speed gearing mechanism, or a conventional electric motor of infinitely variable selective speed per se operatively coupled to such standard driven gear. In such instance, the resultant predetermined time pulse will correspond to the incremental rotational speed at which the standard driven gear is driven by such selective speed operatively coupled electric motor.

The automatic surveillance system has been described in great detail in order that an understanding thereof be fully obtained. However, the illustrative embodiment set forth is not to be considered as any restriction upon the scope of the invention. Variations and modifications may be made without departing from the spirit of the invention as defined in the appended claims.

I claim:

1. Automatic surveillance system for time sequence operations which comprises:

first and second rotary members mounted in operative facing relation for rotation about a common axis, first and second pulse energized rotation imparting means operatively arranged to move independently said first and second rotary members respectively in selective amplitude rotational increments in accordance with the timing of the corresponding pulses of said first and second rotation imparting means, sensing means moving with said first member and selectively rotationally spaced contact means for said second member in operative relation to said sensing means for ascertaining a difference in relative rotational movement between said first and second members, and means for energizing one of said rotation imparting means at a predetermined time pulse and means for energizing the other of said rotation imparting means at a random time pulse in dependence upon the time sequence operation under surveillance.

2. The automatic surveillance system of claim 1 including signal means for indicating said difference in relative rotational movement between said first and second rotary members.

3. The automatic surveillance system of claim 2 in which the pulse energized rotation imparting means comprises a solenoid and an extending arm movable in response to the magnetic impulse of said solenoid.

4. The automatic surveillance system of claim 3 in which the rear portion of said arm is adjacent to said solenoid and a shaft is disposed adjacent to the other end of said arm, said shaft carrying a driving gear and a coil spring having an extension engageable by said arm when said arm is moved under a magnetic pulse of said solenoid.

5. The automatic surveillance system of claim 4 including a leaf spring member in proximity to said extension of said coil spring, said coil spring and said leaf spring member being adapted to be cocked by movement of said arm in response to the magnetic impulse of said solenoid and when released by said arm to cause said coil spring to move said shaft one increment.

6. The automatic surveillance system of claim 4 including a balancing means counteracting the forces exerted upon said shaft during cocking of said coil spring.

7. The automatic surveillance system of claim 6 in which said balancing means comprise a second coil spring disposed about said shaft having an extension engageable with a stop.

8. System according to claim 1 wherein said contact means are in selective rotationally spaced operative relation to said sensing means to ascertain said difference in relative movement in dependence upon corresponding operative change in said spaced relation.

9. System according to claim 1 wherein said contact means are mounted for rotation with said second rotary member and positioned in a common operative rotational path with said sensing means for contact therewith to ascertain said difference in relative rotational movement.

10. System according to claim 9 wherein said contact means are operatively connected to signal means responsive to said contact.

11. System according to claim 10 wherein said contact means are disposed for displacement responsive to said contact for operative engagement in turn with extension means in any rotational position of said second rotary member, said extension means being disposed for corresponding displacement responsive to said engagement.

12. System according to claim 11 wherein said extension means are operatively exposed so as to constitute visual signal means by reason of the corresponding displacement thereof responsive to said engagement.

13. System according to claim 11 wherein said extension means are operatively connected in turn with energizable signal means, said signal means being responsive to said corresponding displacement.

14. System according to claim 10 wherein said sensing means and said contact means comprise energizing switch means and said signal means comprise energizable signal means in operative circuit connection with said switch means.

15. System according to claim 14 wherein said contact means are disposed for displacement responsive to said contact for operative circuit connection engagement in turn with extension means in any rotational position of said second rotary member, said extension means being disposed for corresponding displacement responsive to said engagement for operative circuit connection in turn with said signal means, said signal means in turn being responsive to said corresponding displacement to effect energizing of said signal means.

16. System according to claim 9 wherein said contact means include a pair of rotationally spaced apart contact members and said sensing means is rotationally disposed in the space operatively intermediate said contact members for contact between said sensing means and one of said contact members when the first rotary member is rotating at a relatively faster rate than that of said second rotary member and/or contact between said sensing means and the other of said contact members when the first rotary member is rotating at a relatively slower rate than that of said second rotary member.

17. System according to claim 16 wherein said contact members are disposed for respective displacement responsive to said contact for respective operative engagement in turn with a corresponding pair of extension members in any rotational position of said second rotary member, said extension members being disposed for corresponding respective displacement responsive to said engagement and being operatively exposed so as to constitute visual signal means by reason of the corresponding displacement thereof responsive to said engagement.

18. System according to claim 16 wherein said contact members are disposed for respective displacement responsive to said contact for respective displacement responsive to said contact for respective operative engagement in turn with a corresponding pair of extension members in any rotational position of said second rotary member, said extension members being disposed for corresponding respective displacement responsive to said engagement and being operatively connected in turn with corresponding energizable signal means, said signal means being responsive to said corresponding respective displacement.

19. System according to claim 16 wherein said sensing means and one of said contact members comprise a faster rate switch means and said sensing means and the other of said contact members comprise a slower rate switch means and corresponding energizable signal means responsive to said switch means are provided in respective operative circuit connection with said switch means.

20. System according to claim 19 wherein said contact members are disposed for respective displacement responsive to said contact for respective operative circuit connection engagement in turn with a corresponding pair of extension members in any rotational position of said second rotary member, said extension members being disposed for corresponding respective displacement responsive to said engagement for respective operative circuit connection in turn with said signal means, said signal means being responsive to said corresponding respective displacement to effect respective energizing of said signal means.

21. System according to claim 9 wherein operatively interengaging means are provided on said first and second rotary members to maintain said rotary members in operative relation during said contact between said sensing means and said contact means.

22. System according to claim 1 wherein said sensing means includes a substantially radially extending conductive sensing bridge and said contact means include a pair of rotationally spaced apart and radially offset conductive contact pins mounted for rotation with said second rotary members and positioned in a common operative rotational path with said sensing bridge, said sensing bridge being rotationally disposed in the space operatively intermediate said contact pins and comprising energizing switch means together herewith for contact between said sensing bridge and one of said contact pins when the first rotary member is rotating at a relatively faster rate than that of said second rotary member and for contact between said sensing bridge and the other of said contact pins when the first rotary member is rotating at a relatively slower rate than that of said second rotary member, said contact pins being disposed for respective resilient displacement responsive to said contact for respective operative circuit connection engagement in turn with a corresponding pair of conductive extension members in any rotational position of said second rotary member, said extension members being connected to a corresponding pair of resiliently interposed concentric conductive rings in operative facing relation to said respective contact pins for substantially continuous contact therewith upon said respective displacement, said extension members being disposed for corresponding respective resilient displacement responsive to said engagement for respective operative circuit connection in turn with respective energizable signal means in operative circuit connection with said switch means, said signal means being responsive to said corresponding respective displacement to effect respective energizing of said signal means in ultimate response to said contact between said sensing bridge and one or the other of said contact pins to ascertain said difference in relative rotational movement.

23. System according to claim 22 wherein operatively interengaging means are provided on said first and second rotary members to maintain said rotary members in operative relation during said contact between said sensing bridge and one or the other of said contact pins.

24. System according to claim 1 wherein the random time pulse energized rotation imparting means include a rotary member driving gear mounted for unidirectional rotation and means associated therewith for incrementally rotating said driving gear at said random time pulse.

25. System according to claim 24 wherein the associated means for incrementally rotating said driving gear include a random time pulse operated solenoid, an arm operatively mounted for solenoid controlled displacement from a releasing position to a cocking position, and a resilient urging member operatively mounted for incrementally rotating said driving gear and displaceable by said arm to loaded position when said arm is displaced to cocking position and displaceable against said arm upon release of said arm from solenoid control to urge said arm to releasing position and said driving gear one rotational increment.

26. System according to claim 25 wherein said rotary member driving gear is maintained for forward unidirectional rotation by means operatively connected therewith including forward urging unidirectional rotation gripping means and cooperating reverse arresting unidirectional rotation gripping means, said forward gripping means being operatively connected to said resilient urging member for release operatively of its connection with said driving gear and reverse incremental displacement upon displacement of said resilient urging member to loaded position and in turn for gripping connection operatively with said driving gear and forward incremental displacement with said resilient urging member to urge said driving gear one rotational increment of said forward unidirectional rotation upon release of said arm from solenoid control, and said reverse gripping means being operatively connected to a stop for gripping connection operatively with said driving gear for arresting reverse rotation of said driving gear upon reverse displacement of said forward gripping means and for release operatively of its connection with said driving gear upon forward displacement of said gripping means.

27. System according to claim 26 wherein said driving gear is rotatably mounted on a shaft and said forward and reverse gripping means are corresponding forward and reverse coil springs of opposed helical orientation operatively embracively mounted on said shaft for corresponding alternate gripping and release of said shaft to arrest reverse rotation of said shaft and driving gears by said reverse coil spring upon displacement of said resilient urging member to loaded position and corresponding reverse incremental displacement of said forward coil spring and in turn to achieve forward rotation of said shaft and driving gear by said forward coil spring upon release of said arm from solenoid control.

28. System according to claim 27 wherein the predetermined time pulse energized rotation imparting means include corresponding means to those for said random time pulse energized rotation imparting means.

29. System according to claim 28 wherein said sensing means includes a substantially radially extending conductive sensing bridge and said contact means include a pair of rotationally spaced apart and radially offset conductive contact pins mounted for rotation with said second rotary members and positioned in a common operative rotational path with said sensing bridge, said sensing bridge being rotationally disposed in the space operatively intermediate said contact pins and comprising energizing switch means together herewith for contact between said sensing bridge and one of said contact pins when the first rotary member is rotating at a relatively faster rate than that of said second rotary member and for contact between said sensing bridge and the other of said contact pins when the first rotary member is rotating at a relatively slower rate than that of said second rotary member, said contact pins being disposed for respective resilient displacement responsive to said contact for respective, operative circuit connection engagement in turn with a corresponding pair of conductive extension members in any rotational position of said second rotary member, said extension members being connected to a corresponding pair of resiliently interposed concentric conductive rings in operative facing relation to said respective contact pins for substantially continuous contact therewith upon said respective displacement, said extension members being disposed for corresponding respective resilient displacement responsive to said engagement for respective operative circuit connection in turn with respective energizable signal means in operative circuit connection with said switch means, said signal means being responsive to said corresponding respective displacement to effect respective energizing of said signal means in ultimate response to said contact between said sensing bridge and one or the other of said contact pins to ascertain said difference in relative rotational movement.

30. System according to claim 29 wherein operatively interengaging means are provided on said first and second rotary members to maintain said rotary members in operative relation during said contact between said sensing means and said contact means.

31. System according to claim 1 wherein said contact means are mounted for rotation with said second rotary member and positioned in a common operative rotational path with said sensing means for contact therewith to ascertain said difference in relative rotational movement, and said contact means are operatively connected to energizable signal means responsive to said contact, said sensing means and contact means comprising energizing switch means and said signal means being in operative circuit connection with said switch means, and wherein the random time pulse energized rotation imparting means include a rotary member driving gear mounted for unidirectional rotation and means associated therewith for incrementally rotating said driving gear at said random time pulse, the associated means including a random time pulse operated solenoid, an arm operatively mounted for solenoid controlled displacement from a releasing position to a cocking position, and a resilient urging member operatively mounted for incrementally rotating said driving gear and displaceable by said arm to loaded position when said arm is displaced to cocking position and displaceable against said arm upon release of said arm from solenoid control to urge said arm to releasing position and said driving gear one rotational increment.

32. System according to claim 1 wherein said contact means include a pair of rotationally spaced apart contact members mounted for rotation with said second rotary members and positioned in a common operative rotational path with said sensing means, said sensing means is rotationally disposed in the space operatively intermediate said contact member for contact between said sensing means and one of the said contact members when the first rotary member is rotating at a relatively faster rate than that of said second rotary member and for contact between said sensing means and the other of said contact members when the first rotary member is rotating at a relatively slower rate than that of said second rotary member to ascertain said difference in relative rotational movement, and said contact members are operatively connected to corresponding energizable signal means responsive to said contact, said sensing means and one of said contact members comprising a faster rate switch means and said sensing means and the other of said contact members comprising a slower rate switch means, and said corresponding signal means being in respective operative circuit connection with said switch means, and wherein said first and second time pulse energized rotation imparting means each correspondingly include a rotary member driving gear mounted for unidirectional rotation and means associated therewith for incrementally rotating said driving gear at the corresponding time pulse, the respective associated means each including a corresponding time pulse operated solenoid, an arm operatively mounted for solenoid controlled displacement from a releasing position to a cocking position, and a resilient urging member operatively mounted for incrementally rotating the corresponding driving gear and displaceable by said arm to loaded position when said arm is displaced to cocking position and displaceable against said arm upon release of said arm from solenoid control to urge said arm to releasing position and the corresponding driving gear one rotational increment.

33. Method for automatic surveillance of time sequence operations which comprise rotating a first rotary member in predetermined amplitude rotational increments at a predetermined time pulse and independently rotating a second rotary member in amplitude rotational increments at a random time pulse in dependence upon the time sequence operation under surveillance, and sensing directly coaxially the relative rotational movement between said members during such incremental rotation and substantially continuously throughout any complete revolution thereof for determining deviations between rotational speeds of said second member with respect to said first member.

* * * * *